US009753408B2

(12) United States Patent
Yoshikawa et al.

(10) Patent No.: US 9,753,408 B2
(45) Date of Patent: Sep. 5, 2017

(54) IMAGE FORMING APPARATUS WITH CONTROLLER TO REDUCE ATTACHMENT OF DEVELOPMENT AGENT TO TRANSFER ROLLER

(71) Applicants: Yasuko Yoshikawa, Kanagawa (JP); Junichi Mizawa, Kanagawa (JP); Ichiro Komuro, Tokyo (JP); Shuuichi Endoh, Saitama (JP); Yohsuke Saitoh, Tokyo (JP); Toru Ohmine, Kanagawa (JP); Kenji Sato, Kanagawa (JP); Masato Mukai, Kanagawa (JP)

(72) Inventors: Yasuko Yoshikawa, Kanagawa (JP); Junichi Mizawa, Kanagawa (JP); Ichiro Komuro, Tokyo (JP); Shuuichi Endoh, Saitama (JP); Yohsuke Saitoh, Tokyo (JP); Toru Ohmine, Kanagawa (JP); Kenji Sato, Kanagawa (JP); Masato Mukai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/177,648

(22) Filed: Jun. 9, 2016

(65) Prior Publication Data

US 2016/0370735 A1 Dec. 22, 2016

(30) Foreign Application Priority Data

Jun. 22, 2015 (JP) ..... 2015-125035

(51) Int. Cl.
*G03G 15/16* (2006.01)
*G03G 15/08* (2006.01)

(52) U.S. Cl.
CPC ..... *G03G 15/0894* (2013.01)

(58) Field of Classification Search
CPC ..... G03G 15/0894
(Continued)

(56) References Cited

U.S. PATENT DOCUMENTS 5,194,897 A * 3/1993 Yoshiyama ..... G03G 15/0258 399/100
5,848,326 A 12/1998 Komuro et al.
(Continued)

FOREIGN PATENT DOCUMENTS

JP 7-253730 10/1995
JP 8-152793 6/1996
(Continued)

OTHER PUBLICATIONS

Suzuki, Image Forming Device, Aug. 1999, JP11212340A, Machine English Translation done by JPO, Detailed Description.*

*Primary Examiner* — Susan Lee
(74) *Attorney, Agent, or Firm* — Oblon, McClelland, Maier & Neustadt, L.L.P.

(57) ABSTRACT

An image forming apparatus includes an image bearer to bear a latent electrostatic image thereon, a developing device to supply a development agent to the latent electrostatic image to obtain a visible image, a transfer roller to contact the image bearer to transfer the visible image to a recording medium, a replenishing device to replenish the developing device with the development agent when a density value read from a density detection pattern formed on the image bearer by the developing device is equal to or less than a threshold, a processing device to conduct a predetermined processing to reduce attachment of the development agent to the transfer roller, and a control device to control the number of times the predetermined processing is performed or processing time in performing the predetermined processing
(Continued)

for the processing device, based on whether there is replenishment of the development agent to the developing device.

5 Claims, 5 Drawing Sheets

(58) Field of Classification Search
USPC ..... 399/27
See application file for complete search history.

(56) References Cited

U.S. PATENT DOCUMENTS

| | | | | |
|---|---|---|---|---|
| 6,112,046 | A | 8/2000 | Suzuki et al. | |
| 2007/0009293 | A1 | 1/2007 | Akiba et al. | |
| 2014/0178089 | A1* | 6/2014 | Pino | G03G 15/161 399/71 |

FOREIGN PATENT DOCUMENTS

| | | | |
|---|---|---|---|
| JP | 11212340 | A * | 8/1999 |
| JP | 11242418 | A * | 9/1999 |

* cited by examiner

FIG. 6

| DENSITY SENSOR THRESHOLD | STIRRING TIME | NUMBER OF CLEANING |
|---|---|---|
| A | 10s | ONCE |
| B | 20s | TWICE |
| C | 30s | THREE TIMES |
| D | 40s | FOUR TIMES |

FIG. 7

| CONTROL NUMBER | DENSITY SENSOR THRESHOLD | STIRRING TIME |
|---|---|---|
| 1 | A | 10s (0 – 100s) |
| 2 | B | 20s (0 – 100s) |
| 3 | C | 30s (0 – 100s) |
| 4 | D | 40s (0 – 100s) |

IMAGE FORMING APPARATUS WITH CONTROLLER TO REDUCE ATTACHMENT OF DEVELOPMENT AGENT TO TRANSFER ROLLER

CROSS-REFERENCE TO RELATED APPLICATIONS

This patent application is based on and claims priority pursuant to 35 U.S.C. §119(a) to Japanese Patent Application 2015-125035, filed on Jun. 22, 2015, in the Japan Patent Office, the entire disclosure of which is hereby incorporated by reference herein.

BACKGROUND

Field of the Invention

The present invention relates to an image forming apparatus, a method for controlling the image forming apparatus, and a non-transitory recording medium.

Description of the Related Art

In an image forming apparatus employing a transfer roller system, the back of a recording medium, typically, transfer paper, is easily soiled with toner attached to the transfer roller. In an attempt to prevent this soiling, a bias reverse to a transfer bias is applied to a transfer roller during non-transferring to remove toner from the transfer roller to an image bearer.

SUMMARY OF THE INVENTION

According to the present disclosure, provided is an improved image forming apparatus which includes an image bearer to bear a latent electrostatic image thereon, a developing device to supply a development agent to the latent electrostatic image to obtain a visible image, a transfer roller to contact the image bearer to transfer the visible image to a recording medium, a replenishing device to replenish the developing device with the development agent when a density value read from a density detection pattern formed on the image bearer by the developing device is equal to or less than a threshold, a processing device to conduct a predetermined processing to reduce attachment of the development agent to the transfer roller, and a control device to control the number of times the predetermined processing is performed or processing time in performing the predetermined processing for the processing device, based on whether there is replenishment of the development agent to the developing device by the replenishing device

BRIEF DESCRIPTION OF THE SEVERAL VIEWS OF THE DRAWINGS

Various other objects, features and attendant advantages of the present invention will be more fully appreciated as the same become better understood from the detailed description when considered in connection with the accompanying drawings, in which like reference characters designate like corresponding parts throughout and wherein

FIG. 6 is a table illustrating an example of setting stirring time and the number of times of cleaning corresponding to each of density sensor threshold according to an embodiment of the present disclosure; and FIG. 7 is a table illustrating adding an assignment of management numbers to the table illustrated in FIG. 6 to show that changing the stirring time can be set.

Figure 1:
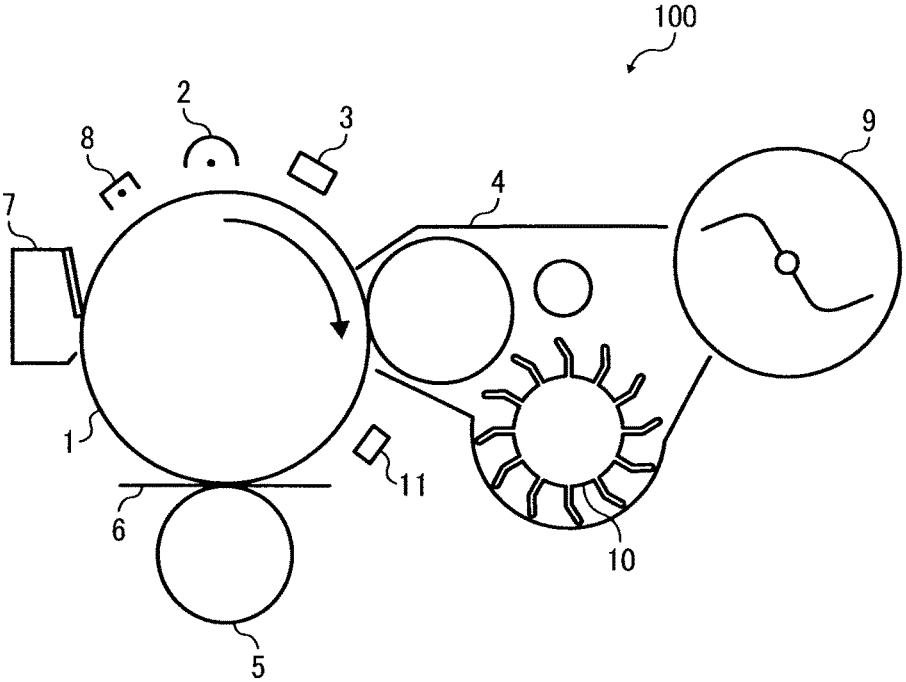
FIG. 1 is a schematic diagram illustrating an embodiment of the image forming apparatus according to an embodiment of the present disclosure.

The accompanying drawings are intended to depict example embodiments of the present invention and should not be interpreted to limit the scope thereof. The accompanying drawings are not to be considered as drawn to scale unless explicitly noted.

DESCRIPTION OF THE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

The image forming apparatus of embodiments of the present disclosure is described with reference to accompanying drawings but the present disclosure is not limited thereto unless it departs from the scope of the present invention. In each drawing, the same symbol is assigned to identical or corresponding parts and the description thereof is not repeated but suitably simplified or omitted.

The image forming apparatus of embodiments of the present disclosure is described with reference to accompanying drawings but the present disclosure is not limited thereto unless it departs from the scope of the present disclosure. In each drawing, the same symbol is assigned to identical or corresponding parts and the description thereof is not repeated but suitably simplified or omitted.

The configuration of an image forming apparatus 100 of an embodiment is schematically described with reference to FIG. 1.

The image forming apparatus 100 includes a photoconductor 1 serving as an image bearer, a charger 2, an irradiator 3, a developing device 4, a transfer roller 5, a cleaner 7, a discharger 8, a toner cartridge 9, and a density sensor 11. The developing device 4 includes a paddle 10 serving as a stirring mechanism to stir toner serving as a development agent replenished from the toner cartridge 9.

For example, a coroner charger is the charger 2 to uniformly charge the photoconductor 1. The irradiator 3 irradiates the surface of the photoconductor 1 charged by the charger 2 with light to form a latent electrostatic image thereon. The developing device 4 supplies toner to the latent electrostatic image formed on the photoconductor 1 to develop the latent electrostatic image to obtain a toner image.

The transfer roller 5 is a transfer device to apply a transfer bias to the photoconductor 1 to transfer the toner image formed on the photoconductor 1 to a recording medium 6 fed between the image bearer 1 and the transfer roller 5.

The cleaner 7 is a cleaning device to remove residual toner on the photoconductor 1 after the toner image is transferred to the recording medium 6. The discharger 8 discharges the photoconductor 1.

The density sensor 11 detects toner density of the density detection pattern periodically formed on the photoconductor 1. The toner cartridge 9 supplies toner to the developing device 4 when the toner density detected by the density sensor 11 is equal to or less than a threshold. For example, the density detection pattern is formed on the photoconductor 1 between when an image is formed on a first recording medium and when formed on a second medium by the developing device 4.

Figure 2:
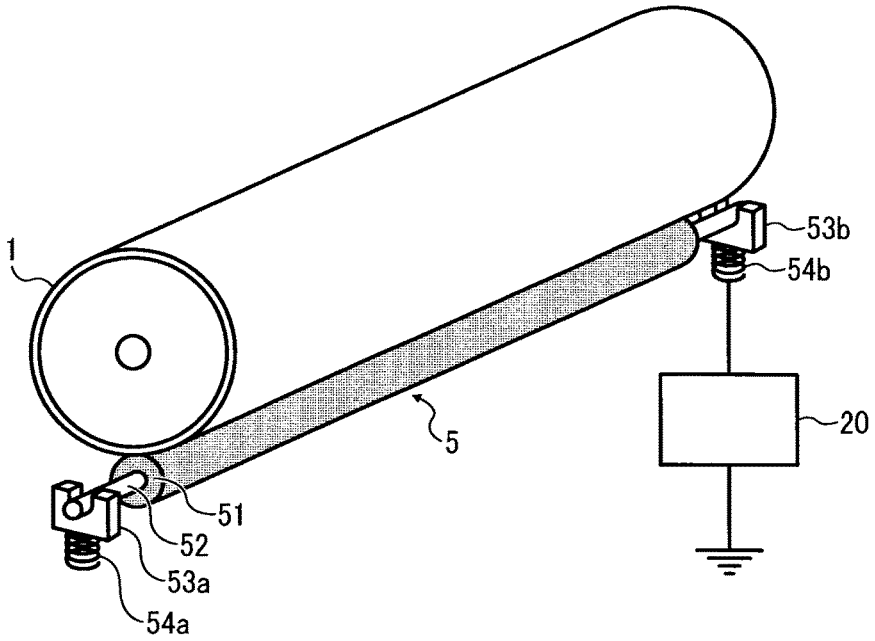
FIG. 2 is a schematic perspective diagram illustrating an image bearer and a transfer roller according to an embodiment of the present disclosure.

Next, the transfer operation by the photoconductor 1 and the transfer roller 5 is described with reference to FIG. 2.

For example, it is preferable to use an organic photoconductor having a width of AO size and an outer diameter of 80 mm.

In addition, the transfer roller 5 preferably has an outer diameter of 37 mm including a stainless metal shaft having an outer diameter of 8 mm around which electroconductive foam is lined. The electroconductive foam serves as an electroconductive elastic layer 51. For example, polyurethane foam, silicone foam, and ethylene propylene foam can be the electroconductive foam. These are obtained by adding a conductivity imparting agent such as carbon black to a foam material.

The transfer roller 5 includes a metal shaft 52 protruding from both ends of the transfer roller 5. The metal shaft 52 is supported by bearings 53*a* and 53*b*. Springs 54*a* and 54*b* are attached to the bearing 53*a* and 53*b* biasing the transfer roller 5 to the photoconductor 1.

In addition, the bearings 53*a* and 53*b* are electroconductive. A power source 20 applies a bias to the transfer roller 5 via the bearings 53*a* and 53*b* and the springs 54*a* and 54*b*.

To transfer the toner image on the photoconductor 1 to a transfer sheet serving as a recording medium, the power source 20 applies a bias having a polarity that is reverse of the charged toner, to the transfer roller 5. That is, in this embodiment, negatively-charged toner is used so that a positive bias is applied to the transfer roller 5 to electrostatically adsorb the toner image to the transfer sheet.

To remove toner attached to the transfer roller 5, negative and positive currents are alternately applied to the transfer roller 5 to cause the toner to be electrostatically attached to the photoconductor 1 by repulsion between the transfer roller 5 and the toner and the attraction between the photoconductor 1 and the toner.

Figure 3:
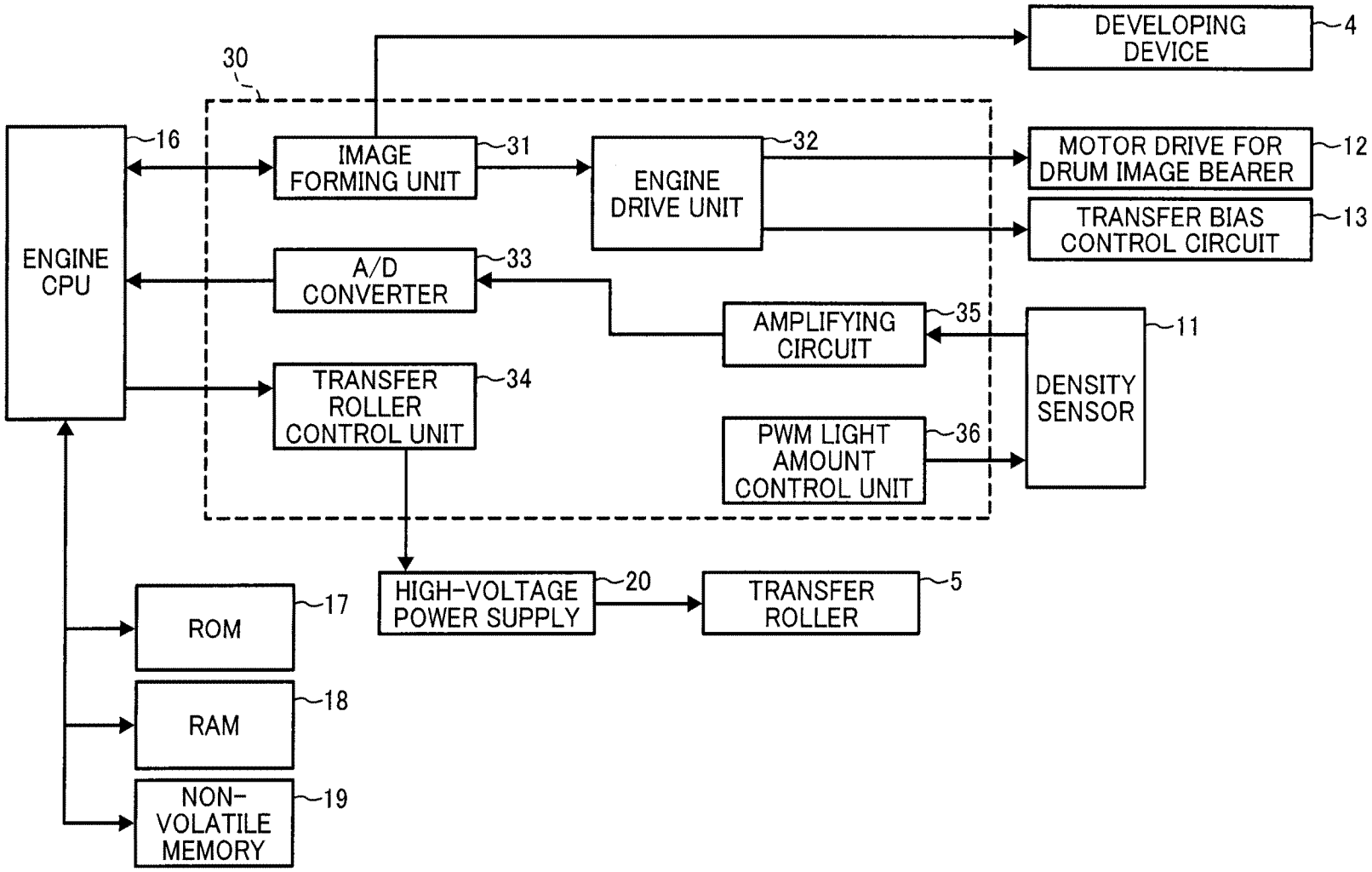
FIG. 3 is a control block diagram illustrating an image forming apparatus according to an embodiment of the present disclosure.

Next, the functional block of the image forming apparatus 100 of this embodiment is described with reference to FIG. 3. The description of the same configuration as illustrated in FIGS. 1 and 2 is omitted. As the internal configuration of the image forming apparatus 100, a drum photoconductor motor driver 12, a transfer bias control circuit 13, an engine CPU 16, a read-only memory (ROM) 17, a random access memory (RAM) 18, a non-volatile RAM 19, and a control unit 30 are illustrated in FIG. 3.

In this embodiment, the control unit 30 includes an image forming unit 31, an engine drive unit 32, an A/D converter 33, a transfer roller control unit 34, an amplifying circuit 35, and a pulse-width modulation (PWM) light amount control unit 36.

The drum photoconductor motor driver 12 controls the engine drive unit 32 to control a motor to rotatably drive (rotate) the photoconductor 1. The transfer bias control circuit 13 controls a transfer bias applied to the transfer roller 5.

The engine CPU 16 controls the control unit 30 and storing devices such as the ROM 17, and the entire of the image forming apparatus 100. The ROM 17 stores the tables illustrated in FIGS. 6 and 7, which are described later. The RAM 18 is a temporary memory to temporarily store the programs the engine CPU 16 executes. The non-volatile RAM 19 stores the replenishing amount of toner in this embodiment, etc.

The image forming unit 31 controls the photoconductor 1 relating to image forming, the charger 2, the irradiator 3, the developing device 4, etc. The engine drive unit 32 controls the drum photoconductor motor driver 12 as described above. The A/D converter 33 acquires an analog signal indicating the density the density sensor 11 detected via the amplifying circuit 35 and converts it into a digital signal, which is sent to the engine CPU 16.

The transfer roller 34 drives the transfer roller 5 and controls the power source 20 applying a bias to the transfer roller 5.

The amplifying circuit 35 amplifies the analog signal indicating the density the density sensor 11 detected. The PWM light amount control unit 36 controls the light amount of the irradiation unit of the density sensor 11 by using PWM.

In this embodiment, the development device 4 and the power source 20 are collectively referred to as a processing device to conduct processing to reduce the attachment of toner to the transfer roller 5 for convenience. More specifically, the processing device corresponds to the paddle 10 serving as a stirring mechanism in the developing device 4 or the power source 20 serving as a cleaning mechanism to clean the transfer roller 5.

In the case of the paddle 10, replenished toner is stirred so that the amount of toner adsorbed to the transfer roller 5 via the photoconductor 1 is reduced. In addition, in the case of the power source 20, negative and positive current is applied to the transfer roller 5 to attract the toner to the photoconductor 1 followed by cleaning the transfer roller 5 to reduce the amount of toner adsorbed to the transfer roller 5.

In this embodiment, the two mentioned above are the processing device. However, any processing capable of reducing the amount of toner adsorbed to the transfer roller 5 is suitable for the processing device.

Next, specific control in the embodiment is described. The engine CPU 16 calculates the replenishing amount of toner from the conversion value by the A/D converter 33 of the output signal indicating the toner density the density sensor 11 detected.

The engine CPU 16 transfers to the transfer roller control unit 34 the stirring time and the number of times of cleaning obtained from, for example, the table stored in the ROM 17 illustrated in FIG. 6, which is described later, and the replenishing amount of toner as calculated above.

Figure 4:
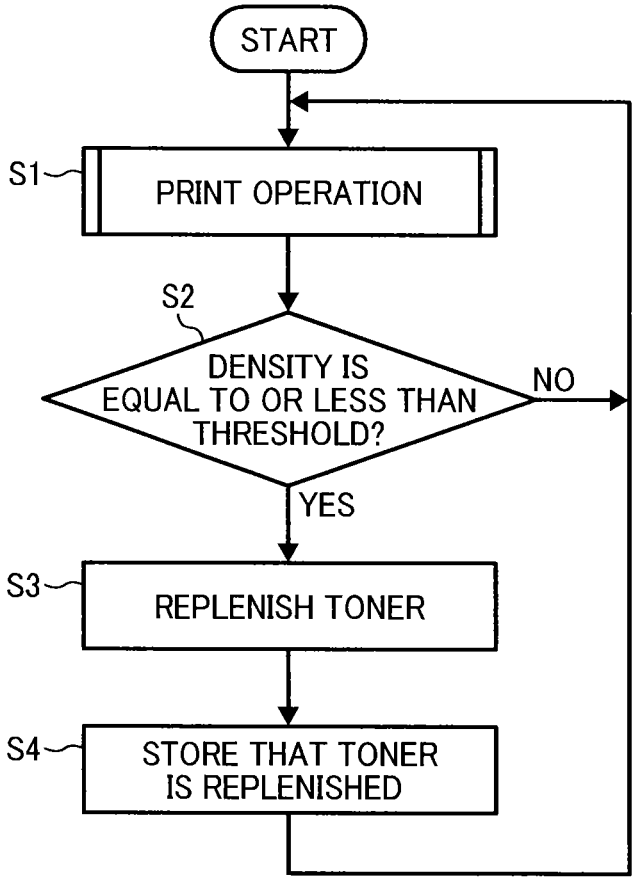
FIG. 4 is a flow chart illustrating procedures of replenishing toner according to another embodiment of the present disclosure.

Next, the toner replenishing processing procedure in this embodiment is described with reference to FIG. 4. In this procedure, for example, a print processing is conducted (Step S1) as image forming processing, thereafter, the density sensor 11 detects the density from the density detection pattern, and the engine CPU 16 determines whether the detected density is equal to or less than a predetermined threshold (Step S2).

When the engine CPU 16 determines that the detected density is equal to or less than the threshold (Yes to Step S2), toner is replenished to the developing device 4 (Steps S3).

When the engine CPU 16 determines that the detected density is not less than the threshold (No to Step S2), the processing returns to printing (Step S1).

The engine CPU 16 stores the replenishing amount of toner and information that the toner is already replenished in the non-volatile RAM 19 (Step S4). For example, the information is stored by setting a flag indicating that the toner is already replenished.

Figure 5:
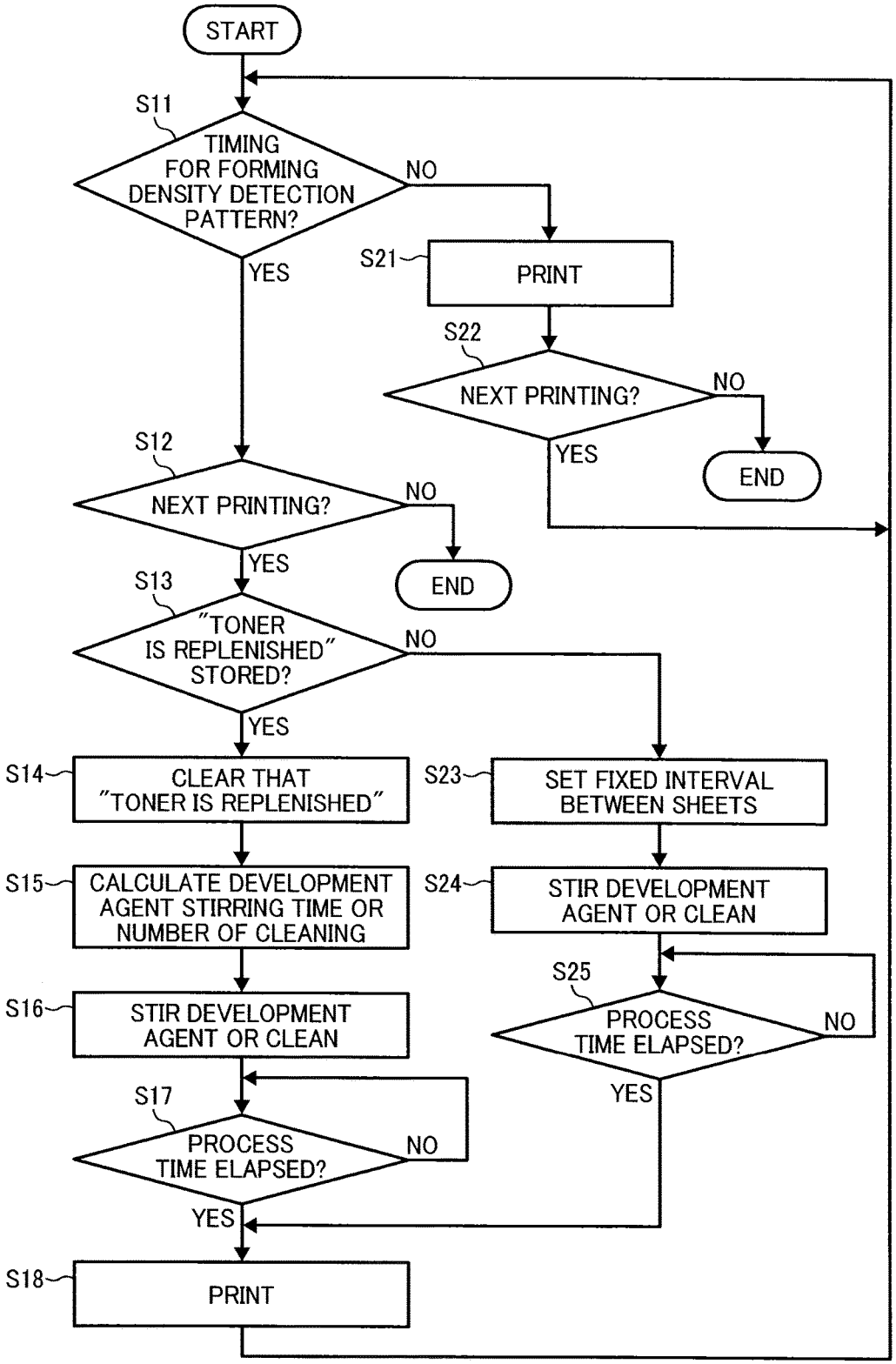
FIG. 5 is a flow chart illustrating control processing procedures according to an embodiment of the present disclosure.

Next, the control processing procedure in this embodiment is described with reference to FIG. 5. The engine CPU 16 determines whether the current time is the time to form the density detection pattern (Step S11). When the engine CPU 16 determines that the current time is not the time to form the density detection pattern (No to Step S11), the operation proceeds to a print processing (Step S21). After printing, if there is a next print job (Yes to Step S22), the engine CPU 16 returns to Step S1. If not (No to Step S22), the operation ends.

On the other hand, when the engine CPU 16 determines to form the density detection pattern at the current time (Yes to Step S11), namely, the density detection pattern is formed on the photoconductor 1, the engine PCU 16 determines whether there is a next print job (Step S12). The engine CPU 16 completes the processing if it determines that there is no print job (No to Step S12).

On the other hand, the engine CPU 16 determines whether the flag indicating that the developing device 4 is already replenished with the toner is stored in the non-volatile RAM 19 (Step S13) when the engine CPU determined that there was a next print job (Yes to Step S12).

When the engine CPU 16 determines that the flag indicating that the developing device 4 is already replenished with the toner is stored in the non-volatile RAM 19 (Yes to Step S13), the already-replenished flag in the non-volatile RAM 19 is cleared (Step S14).

Thereafter, the engine CPU 16 calculates the number of times a predetermined processing is performed and the processing time for the processing device based on the replenishing amount of toner stored in the non-volatile RAM 19 and the table stored in the ROM 17 (Step S15). The predetermined processing by the processing device includes stirring by the paddle 10 serving as a stirring mechanism, and the stirring time is calculated as the processing time in this case. In addition or in alternative, the predetermined processing by the processing device includes cleaning by application of the transfer bias to the transfer roller 5 by the power source 20, and the number of times of cleaning is calculated as the processing time in this case.

Thereafter, the image forming unit 31 and the transfer roller control unit 34 in the control unit 30 control the paddle 10 in the developing device 4 to conduct stirring and the power source 20 to conduct cleaning (Step S16).

The engine CPU 16 determines whether the processing time has passed (Step S17). If yes to Step S17, the image forming unit 31 conducts printing (Step S18). If no to Step S17, the engine CPU 16 stands by until the processing time elapses.

When the engine CPU 16 determines that the flag indicating that the developing device 4 is replenished with the toner is not stored in the non-volatile RAM 19 (No to Step S13), a fixed interval between sheets is set for the next job (Step S23).

The engine CPU 16 causes the paddle 10 to conduct stirring process at the fixed interval between sheets or the power source 20 to conduct cleaning (Step S24). Thereafter, the engine CPU 16 checks the elapse of the processing time (Step S25). If the processing time has elapsed (Yes to Step S25), the image forming unit 31 conducts printing (Step S18). On the other hand, if no to Step S25, the engine CPU 16 stands by until the processing time elapses.

In the procedures (steps) described above, cleaning and stirring are conducted after the toner is replenished and the density detection pattern is formed. However, it is not necessary to conduct cleaning and stirring at this timing. For example, cleaning and stirring can be conducted immediately after the toner is replenished and before the density detection pattern is formed.

An example of the setting stirring time and the number of times of cleaning corresponding to each of density sensor threshold is described with reference to FIG. 6. Density sensor threshold, stirring time, and the number of times of cleaning are set from left to right in FIG. 6. The density sensor thresholds are A, B, C, and D. Corresponding to these, the stirring times are set from 10 to 40 seconds and the number of times of cleanings are set from once to four times. The density increases in the order of from A to D. These are just examples.

In this embodiment, the control device controls the stirring time and the number of times of cleaning according to the density value read from the density detection pattern. For example, if the density value read is the threshold A at most, the stirring time is 10 seconds and the number of times of cleaning is once. In addition, if the density value read surpasses the threshold C and reaches the threshold D, the stirring time is 40 seconds and the number of times of cleaning is four times. Namely, the higher the density read is, the more the stirring time or the number of times of cleaning is.

It is possible to set the density sensor threshold, stirring time, and the number of times of cleaning illustrated in FIG. 6 via the input device the image forming apparatus 100 includes. This makes it possible to conduct processing depending on the usage status of individual users.

In addition, as illustrated in FIG. 7, it is possible to assign a management number to the density sensor threshold, the stirring time, etc. to change them. For example, the management number 1 is set for the density sensor threshold A and the stirring time 10 seconds (0 to 100 seconds). Users can input the management number 1 via the input device to assign the density sensor threshold A and the stirring time 10 seconds corresponding to the management number 1.

As described above, if an image forming apparatus employing a transfer roller system forms an image immediately after toner replenishing, toner adheres to the transfer roller due to shortage of stirring of the toner, which degrades soiling of the back of a recording medium. However, according to the image forming apparatus in the present embodiment, the interval between sheets is increased to increase the development agent stirring time and the transfer roller cleaning, thereby preventing attachment of toner. For this reason, soiling of the back of a recording medium is reduced even after the toner is replenished.

The embodiments described above are just preferred embodiments. Various modifications can be made without departing from the scope of the present invention. For example, each processing in the image forming apparatus of the embodiments described above can be conducted by hardware and/or software.

With regard to use of software, it is possible to conduct processing by software by installing a program that records processing sequences in computer installed into hardware dedicated thereto. Alternatively, processing can be conducted by installing a program in a general-purpose computer that can perform various kinds of processing.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming apparatus comprising:

an image bearer configured to bear a latent electrostatic image thereon;

a developing device configured to supply a development agent to the latent electrostatic image to obtain a visible image;

a transfer roller configured to contact the image bearer to transfer the visible image to a recording medium;

a replenishing device configured to replenish the developing device with the development agent when a density value read from a density detection pattern formed on the image bearer by the developing device is equal to or less than a threshold;

a processing device configured to conduct a predetermined processing to reduce attachment of the development agent to the transfer roller; and a control device configured to control a number of times the predetermined processing is performed or processing time in performing the predetermined processing for the processing device, based on whether there is replenishment of the development agent to the developing device by the replenishing device.

2. The image forming apparatus according to claim 1, wherein the processing device includes a cleaning mechanism configured to clean the transfer roller, wherein the control device controls, as the number of times of the predetermined processing or the processing time, a number of times of cleaning for the transfer roller by the cleaning mechanism based on whether there is replenishment of the development agent to the developing device by the replenishing device.

3. The image forming apparatus according to claim 2, wherein the control device sets the number of times of cleaning according to the density value read from the density detection pattern.

4. The image forming apparatus according to claim 1, wherein the processing device includes a stirring mechanism configured to stir the development agent, and wherein the control device controls, as the number of the predetermined processing or the processing time, a stirring time of the development agent by the stirring mechanism based on whether there is replenishment of the development agent to the developing device by the replenishing device.

5. The image forming apparatus according to claim 4, wherein the control device sets the stirring time according to the density value read from the density detection pattern.

* * * * *